United States Patent [19]

Lee

[11] 4,046,412

[45] Sept. 6, 1977

[54] CABINET WITH LOCK RELEASE

[75] Inventor: Walter F. Lee, Bloomington, Minn.

[73] Assignee: J. N. Johnson Company, Inc., Minneapolis, Minn.

[21] Appl. No.: 653,942

[22] Filed: Jan. 30, 1976

[51] Int. Cl.[2] ..... E05C 3/08

[52] U.S. Cl. ..... 292/200; 292/336.3

[58] Field of Search ..... 292/DIG. 31, 336.3, 292/200, 226, 197; 70/279, 146, 222, 216

[56] References Cited

U.S. PATENT DOCUMENTS

| | | | |
|---|---|---|---|
| 2,440,350 | 4/1948 | Shafer | 292/DIG. 31 |
| 2,900,204 | 8/1959 | Pelcin | 292/DIG. 31 |
| 3,584,483 | 6/1971 | Orr | 292/226 |

*Primary Examiner*—Richard E. Moore

*Attorney, Agent, or Firm*—Wicks & Nemer

[57] ABSTRACT

A cabinet for a fire extinguisher including first and second sidewalls connected to a bottom wall and a top wall with a door-hingedly connected, to a sidewall. A conventional tumbler lock is mounted on the door with a latch on the inner end engageable with a catch mounted on the inside of the cabinet. A small closure plate is hingedly mounted at an opening formed in the door adjacent the lock. The closure plate is releasably held closed by a strip of adhesive so that when the closure plate is pushed inwardly of the opening, the edge of the closure plate progressively contacts the latch and disengages the same from the catch thereby allowing the door to be opened.

3 Claims, 6 Drawing Figures

CABINET WITH LOCK RELEASE

SUMMARY

The invention relates broadly to an improvement in cabinets for fire extinguishers and more particularly to a cabinet having a door equipped with a key lock and a supplementary lock release for use in an emergency. It is an object of the invention to provide means for opening the cabinet by a person requiring the extinguisher for emergency use but without a key for the lock. The means includes a relatively small opening formed in the door with a closure plate hingedly mounted at the opening and releasably held closed upon the opening by an adhesive strip at an edge of plate and upon the inner surface of the door. A latch is mounted on the inner end of the lock which is actuated by the edge of the closure plate as the plate is hingedly moved through the opening into the cabinet. While the cabinet can be gotten into by a thief to steal the fire extinguisher, it allows a locked cabinet but with entry for use of the extinguisher in an emergency, but which requires a positive act to open the cabinet by the emergency lock. The lock deters vandalism but allows an opening of the cabinet in an emergency.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
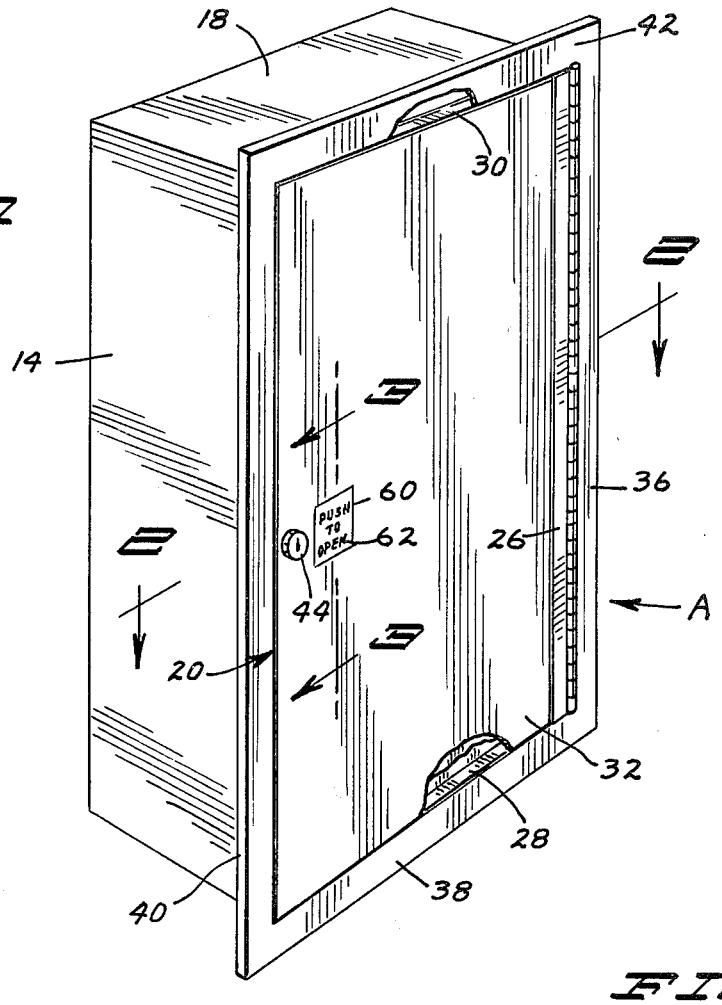
FIG. 1 is a perspective view of a cabinet for a fire extinguisher with push plate lock release embodying the invention.
Figure 2:
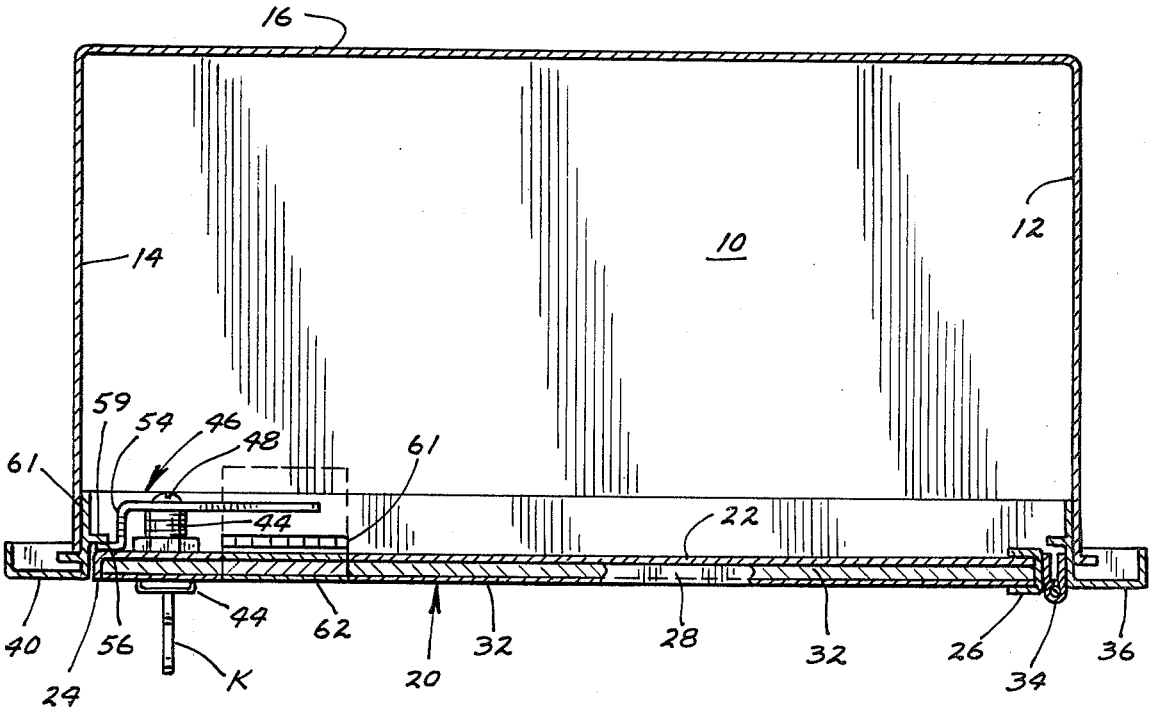
FIG. 2 is a sectional view on the line 2—2 of FIG. 1.
Figure 3:
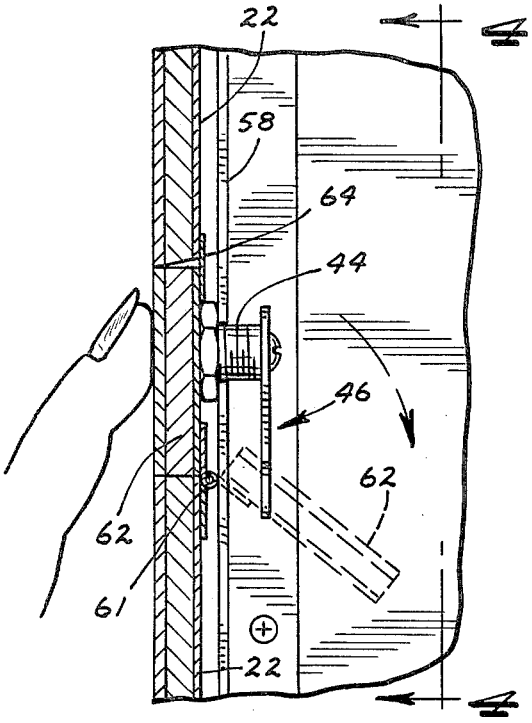
FIG. 3 is a sectional view on the line 3—3 of FIG. 1 with the push plate lock release shown in released position in broken lines.
Figure 4:
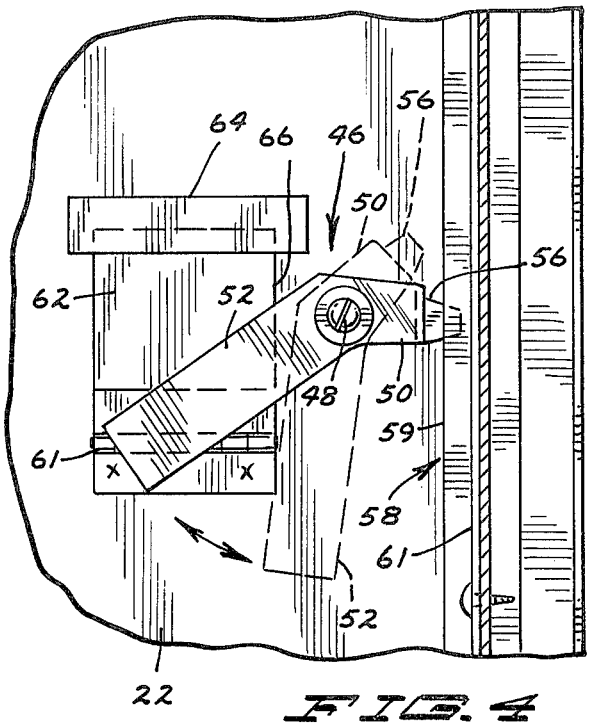
FIG. 4 is on the line 4—4 of FIG. 3.
Figure 5:
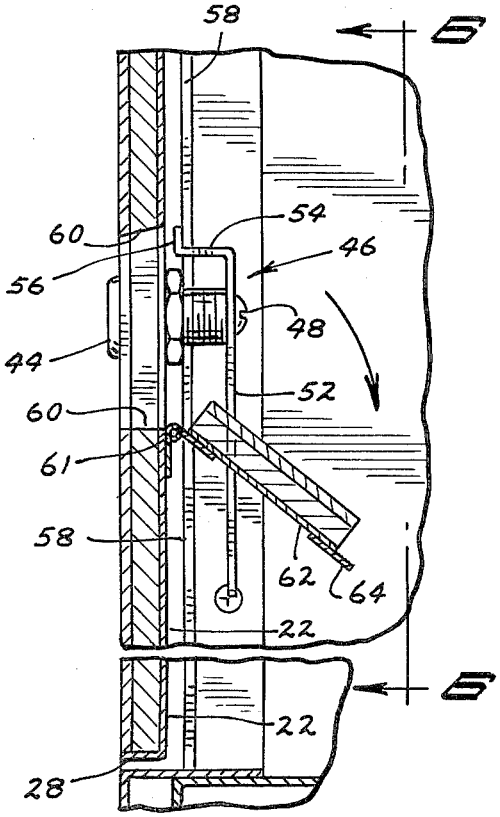
FIG. 5 is a sectional view similar to that of FIG. 3 but with the plate shown in released position.

Referring to the drawings in detail, the cabinet with push plate lock release A includes the bottom 10 to which is connected the first sidewall 12 and the second sidewall 14. The sidewalls 12 and 14 and the bottom wall 10 are connected to the back wall 16 with the sidewalls and back wall connected to the top wall 18. Further provided is the door 20 which includes the back plate 22 which is formed on the jam edge thereof the flange 24. Secured to the hinge edge of the back plate 22 is the channel 26, and formed on the bottom edge of the back plate is the flange 28. The top edge of the back plate 22 is formed with the flange 30. Positioned between and in abutment with the flanges 24, 28 and 30 and within the channel 26 is the plastic sheet member 32. The channel 26 has secured thereto the hinge 34 which hinge is also secured to the first door side frame member 36. The frame 36 is connected to the wall 12, and the bottom frame member 38 is connected to the bottom 10 together with the second side frame member 40 connected to the sidewall 14. Also provided is the top frame member 42 connected to the top wall 18. The door 32 hingedly closes flush with the door frame members.

The numeral 44 designates a conventioned key tumbler lock mounted in the door 20, the lock including a latch in the form of the arm 46 mounted on and secured to the inner end of the lock by means of the bolt 48. The latch arm 46 includes the base portion 50 from which the leg portion 52 extends at substantially an angle of 130°. The base portion 50 of arm 46 is formed with right angle flange portion 54 which terminates in the right angle catch lip 56.

The sidewall member 14 has secured to the inner surface thereof and within the door 20 the angle member 58 having the catch in the form of flange portion 59 and leg 61. Further provided is the opening 60 formed in the door 20 adjacent the lock 44, and hingedly mounted at the opening at the lower edge thereof is the hinge 61 of the closure member in the form of plate 62. The plate 62 has printed on the outer surface thereof the indicia "Push to Open". Mounted on the inner face of the closure plate and extending from the upper edge thereof is the adhesive tape member 64 which engages the inner face of the back plate 22 thereby holding the closure plate in a releasably closed position within the opening 60.

OPERATION

Figure 6:
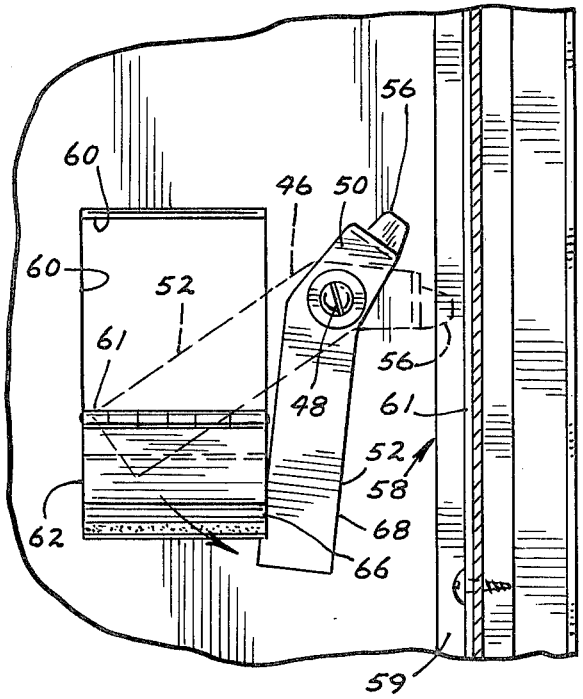
FIG. 6 is a view on the line 6—6 of FIG. 5.

The cabinet is locked by using the key K to rotate the lock 44 whereby the arm 46 is rotated to engage the lip 56 under the flange 58. In the locked condition with the lip 56 engaged under flange 58, the cabinet may be opened in an emergency without the use of a key by pushing inwardly on the plate 62, which releases the adhesive strip 64 and as the plate hingedly pivots inwardly, the side edge 66 of the plate bears progressively against the edge 68 of the leg portion 52 of arm 46 whereby the leg portion is pushed downwardly thereby pivoting the arm base 50 substantially to the position of FIG. 6. As a result of the above, the catch lip 56 of arm base 50 is moved from under the flange 58 to the position as illustrated in FIG. 6 whereby the door may be opened to allow procurement of a fire extinguisher or other articles therein.

Having thus described the invention, what is claimed as new and desired to be secured by Letters Patent is:

1. A cabinet with lock release comprising:

a. first and second sidewalls connected to b. a bottom wall and c. a top wall, d. a door pivotally connected to a sidewall, e. a lock mounted on said door and extending within said cabinet, f. a latch arm pivotally connected to the inner end of said lock for operation by said lock and including a lip at one end engageable with g. catch means carried by a wall of said cabinet internally thereof, h. said latch arm including a leg portion at the other end, i. said door having an opening formed therein adjacent said lock, j. a plate pivotally mounted on the door at the edge of the opening and forming a closure for the opening, k. said plate pivotally movable from the opening into the cabinet with the edge of the plate contacting and pivoting said leg portion of said latch arm independent of said lock for disengagement of said lip of said latch arm from said catch means to allow opening of said door.

2. The device of claim 1 in which said catch means includes a flange.

3. The device of claim 2 including means for releasably holding said plate in a closed position upon said opening.

* * * * *